United States Patent [19]

Kim

[11] 4,135,093

[45] Jan. 16, 1979

[54] USE OF PREDISSOCIATION TO ENHANCE THE ATOMIC HYDROGEN ION FRACTION IN ION SOURCES

[75] Inventor: Jinchoon Kim, Oak Ridge, Tenn.

[73] Assignee: The United States of America as represented by the United States Department of Energy, Washington, D.C.

[21] Appl. No.: 871,880

[22] Filed: Jan. 24, 1978

[51] Int. Cl.[2] ..... H01J 27/00

[52] U.S. Cl. ..... 250/423 R; 250/426

[58] Field of Search ..... 250/423 R, 426

[56] References Cited

U.S. PATENT DOCUMENTS 3,740,554 6/1973 Morgan ..... 250/423 R

OTHER PUBLICATIONS

"A Low Current — Ion Source" by Steinberg et al., The Review of Sci. Inst., vol. 42, No. 3, Mar. 1971, pp. 354, 355.

*Primary Examiner*—Harold A. Dixon

*Attorney, Agent, or Firm*—Dean E. Carlson; Stephen D. Hamel; Louis M. Deckelmann

[57] ABSTRACT

A duopigatron ion source is modified by replacing the normal oxide-coated wire filament cathode of the ion source with a hot tungsten oven through which hydrogen gas is fed into the arc chamber. The hydrogen gas is predissociated in the hot oven prior to the arc discharge, and the recombination rate is minimized by hot walls inside of the arc chamber. With the use of the above modifications, the atomic $H_1^+$ ion fraction output can be increased from the normal 50% to greater than 70% with a corresponding decrease in the $H_2^+$ and $H_3^+$ molecular ion fraction outputs from the ion source.

6 Claims, 2 Drawing Figures

USE OF PREDISSOCIATION TO ENHANCE THE ATOMIC HYDROGEN ION FRACTION IN ION SOURCES

BACKGROUND OF THE INVENTION

This invention was made in the course of, or under, a contract with the U.S. Department of Energy.

The present invention is an improvement over the duopigatron ion source described in U.S. Pat. No. 3,740,554, issued June 19, 1973, to Ora B. Morgan, Jr., and entitled "Multi-Ampere Duopigatron Ion Source." The present invention also has utility in conventional duoplasmatrons or in Berkeley-type ion sources, for example.

In a typical duopigatron ion source, such as described in the above patent, a glow discharge is produced in the arc chamber above the intermediate electrode aperture. The weak plasma streams into the magnetic field region exterior to the intermediate electrode and inside the anode where a PIG-type discharge further enhances the plasma density. Ions are extracted from this more dense plasma and accelerated to high energy in the multiple-aperture accel-decel electrode structure. The resulting ion beam can then be passed through a charge-exchange gas cell for producing a neutral beam when such a beam is desired for injection into an experimental hot plasma producing device such as the ORNL ORMAK, for example.

The source gas usually fed into the plasma region device above the intermediate electrode aperture of the above prior ion source is ordinary hydrogen gas, for example. However, it should be understood that deuterium or tritium gas could be utilized as the feed gas to such ion sources if desired.

When hydrogen gas is utilized in such ion sources, they generally produce multi-momentum beams consisting of atomic hydrogen ions ($H_1^+$) and molecular hydrogen ions ($H_2^+$ and $H_3^{3+}$). If the ion source is to be used for neutral beam injection into an experimental plasma producing device, only the single ion species $H_1^+$ is desired. The molecular ions, in passing through the charge-exchange gas, break up into atoms with one-half (from $H_2^+$) or one-third (from $H_3^+$) of their accelerated energy. These lower energy components do not penetrate deeply into the plasma of an experimental plasma producing device and may be unwanted or of little use if the heating of the outside portion of the experimental plasma yields an adverse effect.

Thus, for neutral beam injection purposes, the need exists for a means and a method of enhancing the atomic hydrogen ion fraction $H_1^+$ of hydrogen ion sources such as duopigatrons, duoplasmatrons, and Berkeley-type ion sources while at the same time minimizing the molecular $H_2^+$ and $H_3^+$ ion fractions. The present invention was conceived to meet this need in a manner to be described hereinbelow.

SUMMARY OF THE INVENTION

It is the object of the present invention to provide an improved hydrogen ion source for producing an ion beam with an enhanced atomic ion fraction and with reduced molecular ion fractions.

The present invention accomplishes the above object in a duopigatron ion source by replacing the normal oxide-coated wire filament cathode with a hot tungsten oven through which hydrogen gas is fed into the arc chamber and by providing tungsten liners inside of the arc chamber which allow higher wall temperatures inside the ion source. The hot tungsten oven is heated by a direct current passing coaxially so as not to generate a net magnetic field outside the cylindrical oven and also serves to emit the cathode electrons needed for sustenance of the arc discharge. If the oven is maintained at a temperature of 2400° K., or greater, about 95% of the hydrogen molecules become dissociated through multiple collisions with the hot tungsten surface of the oven. Since the ion source gas pressure is normally low, i.e., 0.1 Torr or lower, only a small amount of recombination due to collisions between particles would be expected. The predominant mechanism from the generation of molecular hydrogen would be the gas desorption from the wall surfaces. Surface recombination, however, is minimized by keeping the nearby walls at high temperature, typically far above 1000° K. Thus, by dissociating the hydrogen gas in the ion source oven prior to arc discharge, and simultaneously minimizing the recombination rate inside the ion source by a hot-wall environment, the above object can be achieved. This method may also be applied to other types of ion sources to enhance the atomic ion fraction.

DESCRIPTION OF THE PREFERRED EMBODIMENT

Figure 1:
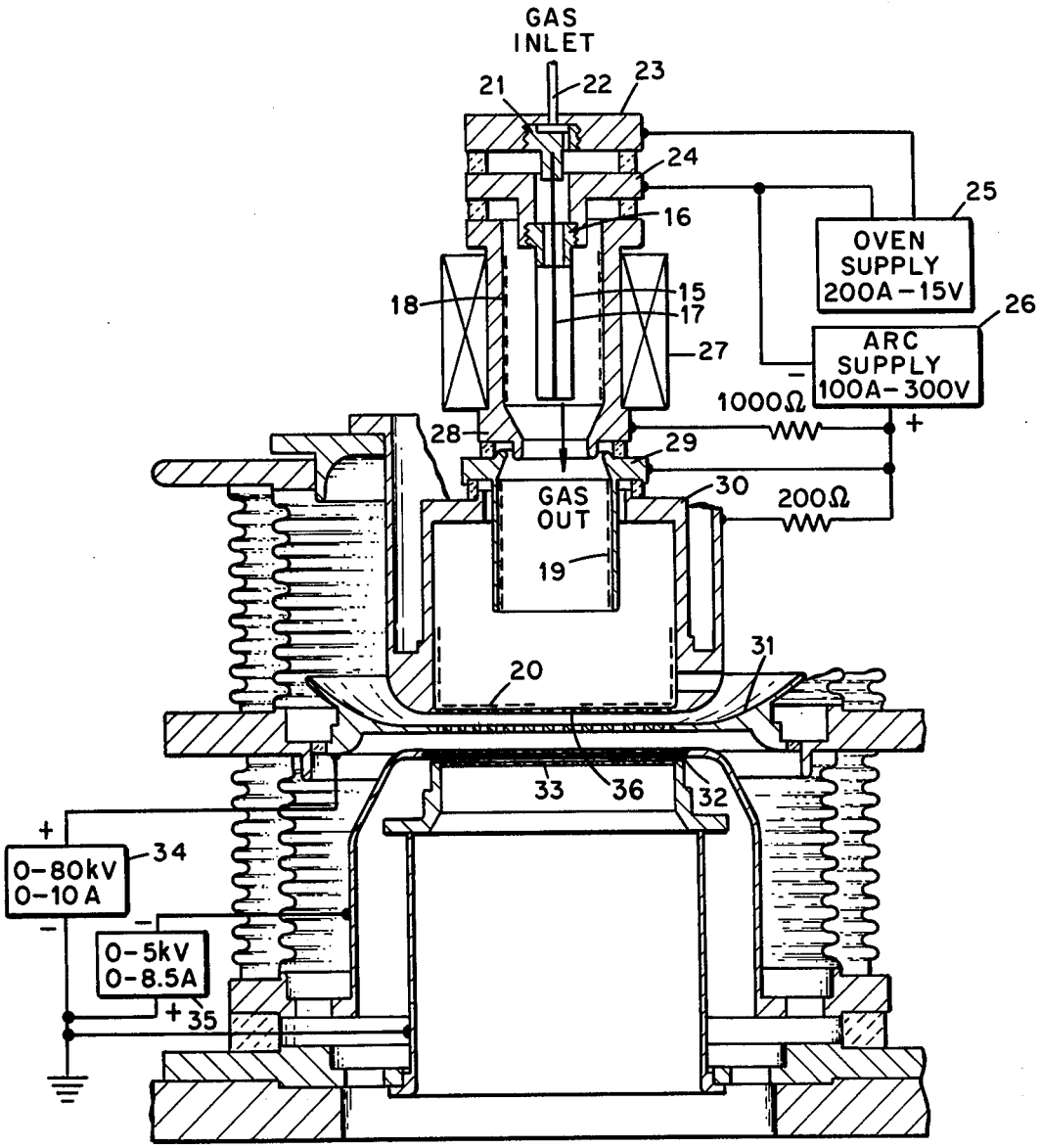
FIG. 1 is a sectional view of the improved duopigatron ion source of the present invention.

The duopigatron ion source with the hydrogen dissociator of the present invention is illustrated in FIG. 1 of the drawings. The tungsten oven-cathode 15 is a cylinder which is clamped at one end thereof around a tantalum collar 16 which in turn is supported in a metallic support member 24. A tantalum support member 21 is fitted within a metallic support member 23 which is insulated from the support member 24. One end of a tungsten rod 17 is fitted within the member 21 and extends coaxially through the member 24, the collar 16 and the oven 15. The other end of the cylindrical oven 15 is clamped against a loop, not shown, in the other end of the coaxial tungsten rod 17.

A 200 A-15 V power supply 25 is connected to the members 23 and 24 such that heating current is adapted to pass through the coaxial cylinder 15 and rod 17 without generating a net magnetic field outside the cylinder 15, an essential feature for stable duopigatron operation.

Hydrogen gas is fed through an inlet feed tube 22 and then through the oven 15 where it is dissociated as it flows therethrough and then out the open end of the oven.

Member 28 is an intermediate electrode encompassing the oven 15, and a source magnet coil 27 in turn encompasses the electrode 28. The coil 27 is adapted to be connected to a magnet power supply, not shown, in a conventional manner. Insulated from the electrode 28 is a cylindrical copper anode 29, and insulated from the anode 29 is a target cathode 30. A 100 A-300 V arc power supply 26 is connected to the cathode 15, to the electrode 28, to the anode 29, and to the target cathode 30 as shown in FIG. 1.

Several tungsten sheets 18 line the inside surface of the intermediate electrode 28 and provide thermal shielding and hot surfaces. These sheets 18 are heated by thermal radiation from the oven 15. Similar tungsten liners, 19 and 20, mounted on the inside surfaces of the tail of the anode 19 and of the target cathode 30, respectively, are heated by the arc plasma. The lower end of the target cathode 30 is provided with a multi-apertured closure member 36, and the liner 20 is in the shape of a cup and is positioned in the lower end of the target cathode as shown in FIG. 1 of the drawings.

A multi-apertured extraction electrode 31 is mounted just below the closure member 36 of the target cathode 30 in spaced relation thereto. A multi-apertured accelerating electrode 32 is mounted below the electrode 31 in spaced relation thereto, and a multi-apertured decelerating electrode 33 is mounted below the electrode 32 in spaced relation thereto. The electrodes 31, 32, and 33 and the closure member 36 are each provided with 221-0.38 cm. diameter, aligned apertures, for example. The electrode 31 is connected to a power supply 34, the electrode 32 is connected to a power supply 35, and the electrode 33 is connected to ground as shown in FIG. 1. It should be understood that the members 36, 31, 32 and 33 are insulated each from the others.

The operation of the above-described ion source is essentially the same as described in the above-mentioned prior patent except that the source feed gas is dissociated in the tungsten oven which also serves as a cathode for supplying thermionic electrons needed for sustaining the arc discharge of the ion source. Another difference from the above-mentioned prior patent is the extra electrode 36 added for further acceleration of the ion beam, which is not directly related to the present invention. As mentioned above, the oven 15 is maintained at a temperature of 2400° K. or greater by the power supply 25 such that about 95% of the hydrogen molecules become dissociated through multiple collisions with the hot tungsten surface of the oven. Since the tungsten liners 18 are substantially heated by the oven 15 and the tungsten liners 19 and 20 are heated by the arc plasma of the ion source, these heated liners together with the hot oven 15 provide a hot-wall environment inside the ion source thereby effecting a minimization of the surface recombination rate inside the ion source, thus substantially reducing the generation of the molecular hydrogen ion fractions previously caused by surface recombination in the prior art.

An example of the improved results achieved with the present ion source, as described above, is illustrated in FIG. 2 of the drawings. The filled data points in FIG. 2 for the atomic hydrogen ion beam fraction $H_1^+$ and the molecular beam ion fractions $H_2^+$ and $H_3^+$ as a function of total arc power supply drain current illustrate typical results achieved in the operation of a typical, prior art duopigatron ion source employing an oxide-coated filament cathode. On the other hand, the open data points in FIG. 2 for the atomic hydrogen ion beam fraction $H_1^+$ and the molecular ion beam fractions $H_2^+$ and $H_3^+$ as a function of total arc power supply drain current illustrate typical results achieved in the operation of the present ion source as described above.

Figure 2:
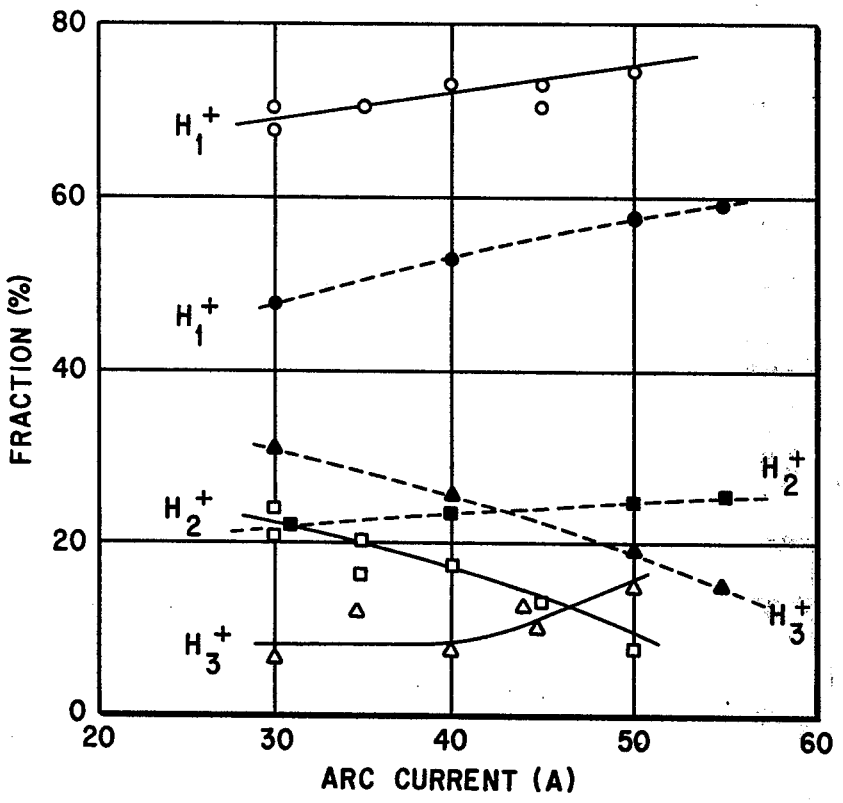
FIG. 2 is a graph illustrating the differences in the respective ion fractions produced in a duopigatron ion source with and without predissociation of the feed gas to the source.

As can be seen from the respective set of curves in FIG. 2, there is achieved a substantial increase in the atomic ion beam fraction $H_1^+$ (about 20%) in the operation of the present ion source as compared to the atomic ion beam fraction $H_1^+$ of the prior art ion source, while at the same time the molecular ion beam fractions $H_2^+$ and $H_3^+$ are correspondingly decreased with the present ion source operation as compared to the prior art ion source operation. Thus, the predissociation technique of the present ion source provides for a significant improvement in the atomic ion beam fraction and a corresponding decrease in the molecular ion beam fractions achievable in the operation thereof, thus meeting the above-stated object. It should be understood, however, that an even better enhancement of the atomic ion fraction could be achieved in the present invention by providing external heating means for the liners or interior walls of the ion source to supplement the heating thereof by the arc discharge plasma to thus further decrease the surface recombination rate.

The output of the present ion source, as described above, can be passed through a hydrogen gas cell for thus producing a neutral hydrogen beam, when such is desired, in a manner as described in the above-mentioned prior patent.

It should be understood that comparable results can be achieved in the operation of the above-described ion source when deuterium or tritium feed gas is utilized in the operation thereof instead of hydrogen.

Two important advantages provided by the above-described ion source are: (1) increased neutral beam injection power efficiency because of the increased full-energy component; and (2) improvement in the cathode lifetime over the prior commonly-used oxide filaments.

This invention has been described by way of illustration rather than by limitation and it should be apparent that it is equally applicable in fields other than those described.

What is claimed is:

1. In a method of operating a duopigatron ion source comprising the steps of producing a glow discharge from a feed gas within the intermediate electrode thereof by an oxide-coated wire filament cathode to thereby produce a weak plasma, producing a PIG-type arc discharge between a cylindrical anode and a target cathode from said weak plasma exiting from said intermediate electrode thereby enhancing the plasma density, and extracting ions from said enhanced plasma by means of a multiple-aperture acceleration-deceleration electrode structure, the improvement comprising the steps of replacing said oxide-coated wire filament cathode with a cylindrical tungsten oven cathode, heating said oven cathode with a source of electrical supply to a desired temperature, passing said feed gas through said heated oven cathode where it is substantially pre dissociated within said oven cathode before passing therefrom, said heated oven cathode also supplying thermionic electrons for sustaining said PIG-type arc discharge, and placing tungsten liners on the inside walls of said intermediate electrode, of said anode, and of said target cathode, said liner of said intermediate electrode being heated by thermal radiation from said heated oven cathode, said liners of said anode and target cathode being heated by said arc discharge, thereby effecting a substantial increase in the atomic ion fraction and a corresponding decrease in the molecular ion fractions in the output beam from said ion source.

2. The method set forth in claim 1, wherein said oven cathode is maintained at a temperature of at least 2400° K. by said electrical supply.

3. The method set forth in claim 2, wherein said feed ga is selected from the group consisting essentially of hydrogen, deuterium and tritium.

4. An improved duopigatron ion source comprising an elongated, cylindrical, electron emitting tungsten cathode; a tungsten rod extending coaxially within said cathode and electrically joined at one of its ends with the exit end of said cathode; a source of feed gas adapted to be passed through said cylindrical cathode; a first power supply coupled between the other end of said rod and cathode to supply heating current thereto and provide thermionic electrons therefrom; said cathode serving as an oven for dissociating said feed gas as it passes through said oven cathode and supplying said electrons; a cylindrical intermediate electrode spaced from and encompassing said cathode and provided with an apertured, tapered lower end portion; a source magnet encompassing the upper portion of said intermediate electrode and adapted to be connected to a second magnet supply source; a cylindrical copper anode spaced and insulated from said intermediate electrode; an elongated cylindrical target cathode spaced and insulated from said anode; said target cathode provided with a multi-apertured closure member at the lower end thereof; a multi-apertured extraction electrode mounted beyond and closely spaced from said target cathode closure member; a multi-apertured acceleration electrode mounted beyond and closely spaced from said acceleration electrode; a multi-apertured deceleration electrode mounted beyond and closely spaced from said acceleration electrode; a third arc power supply source coupled between said cathode and said intermediate electrode, between said cathode and said anode, and between said cathode and said target cathode; a fourth power supply source coupled to said extraction electrode; a fifth power supply source coupled to said acceleration electrode, said deceleration electrode being connected to ground; a first tungsten liner mounted on the inside wall of said intermediate electrode; a second tungsten liner mounted on the inside wall of said anode; and a third tungsten cup-like liner mounted on the inside walls of the lower portion of said target cathode and a portion of said target cathode closure member, whereby during operation of said ion source the dissociation of said feed gas effected by said oven cathode plus the hot wall environment provided by said respective liners effects a substantial increase in the atomic ion fraction and a corresponding decrease in the molecular ion fractions in the output beam from said ion source.

5. The ion source set forth in claim 4, wherein said cylindrical oven cathode is maintained at a temperature of at least 2400° K. by said first power supply.

6. The ion source set forth in claim 5, wherein said feed gas is selected from the group consisting essentially of hydrogen, deuterium and tritium.

* * * * *